United States Patent [19]

Wilen

[11] Patent Number: 5,010,723

[45] Date of Patent: Apr. 30, 1991

[54] TWISTED YARN WHICH WILL MAINTAIN ITS TWIST AND PRODUCTS PRODUCED THEREFROM

[75] Inventor: Joseph M. Wilen, Atlanta, Ga.

[73] Assignee: Wilen Manufacturing, Atlanta, Ga.

[21] Appl. No.: 427,728

[22] Filed: Oct. 26, 1989

[51] Int. Cl.[5] ..... D02G 3/40

[52] U.S. Cl. ..... 57/210; 57/234; 57/242

[58] Field of Search ..... 57/210, 232, 234, 236, 57/238, 242

[56] References Cited

U.S. PATENT DOCUMENTS

| | | | |
|---|---|---|---|
| 2,313,058 | 3/1943 | Francis | 57/234 X |
| 3,429,354 | 2/1969 | Brooks | 57/210 X |
| 3,828,544 | 8/1974 | Alker | 57/210 |
| 4,191,221 | 3/1980 | Boyer | 57/210 X |

FOREIGN PATENT DOCUMENTS

| | | | |
|---|---|---|---|
| 311199 | 4/1989 | European Pat. Off. | 57/234 |

*Primary Examiner*—Joseph J. Hail, III

*Attorney, Agent, or Firm*—Hurt, Richardson, Garner, Todd & Cadenhead

[57] ABSTRACT

A yarn produced from two or more twisted cellulosic fibers, such as cotton or cotton rayon fibers, the plies being helically wound around a thermoplastic filament core which is subsequently melted to bind the inner portions of the yarn together so that it does not untwist or shed lint readily. The yarn is employed in a dust mop or floor mat for a shampoo bonnett for stain resistant treated carpet.

1 Claim, 1 Drawing Sheet

TWISTED YARN WHICH WILL MAINTAIN ITS TWIST AND PRODUCTS PRODUCED THEREFROM

BACKGROUND OF THE INVENTION

This invention relates to a twisted yarn and is particularly concerned with a twisted yarn which will maintain its twisted condition and to products produced therefrom, namely dust mops, mats, pads for shampoo bonnetts and fringes.

For a very long time, dust mops have been extensively manufactured and used in this country. Certain of these dust mops have fabric bodies which are adapted to be removeably inserted onto the frame of the mop, the fabric body having a tufted surface formed of cut pile tufts sewn into the lower portion of the body. These tufts are usually surrounded by a perimetrical fringe consisting of lengths of yarn which protrude outwardly from the edges of the mop.

Also in the prior art are mats which are in the form of scatter rugs or throw rugs or shampoo bonnetts having backing material and cut pile tufts. These scatter rugs and throw rugs also usually contain a fringe which surrounds the tufted material, the fringe consisting of lengths of yarn stitched to the edges of mop or mat. The end portions of these fringes usually consist of cut yarns. The yarns of all of the above-discussed products are usually made of cotton which will readily untwist when the product is washed and, therefore, when the product is used after being washed, these products generally will fray and create lint.

In the prior art, efforts have been made to heat set the yarns so that they retain their twist and do not readily fray. Such heat setting, however, causes the yarns to be much stiffer than just a conventional cotton yarn and therefore the yarns are not soft or pliable as would be found in a conventional cotton dust mop or cotton mat.

Briefly described, the present invention, which overcomes the difficulty described above, includes a yarn which is made from plies of cellulosic fibers, either spun cotton or spun rayon or blend of cotton and rayon which are helically twisted with a monofilament thermoplastic filament, the resulting yarn then being heated until the filament is tacky or molten so that the thermoplastic filament bonds the plies of yarn together. A twisted yarn made in this manner, when incorporated into a dust mop or into a mat, provides a product which has reduced linting and a useful life which is usually more than two or three times longer than the life a conventional mop or mat. The breaking strength of the yarns are usually doubled by such a construction. The twisted yarns of the mop or mat will not readily untwist when laundered and yet provides products which maintain their soft, pliable yarns. The twisted yarns tend to stay essentially straight in the mop or mat and do not readily mat with other yarns. The binder formed by the thermoplastic element does not appreciably adversely effect the hydrophilic nature of the twisted yarn.

Accordingly, it is an object of the present invention to provide a twisted yarn which is inexpensive to manufacture, durable in structure and efficient in operation.

Another object of the present invention is to provide a twisted yarn which does not readily generate lint.

Another object of the present invention is to provide a hydrophilic twisted yarn and products therefrom which has an extended useful life.

Another object of the present invention is to provide a twisted yarn which has an improved breaking strength.

Another object of the present invention is to provide a twisted yarn which can be laundered better than a conventional yarn.

Another object of the present invention is to provide a twisted yarn which can withstand repeated launderings, without being materially untwisted.

Another object of the present invention is to provide a dust mop which has reduced linting characteristics.

Another object of the present invention is to provide a dust mop which has an extended useful life.

Another object of the present invention is to provide a dust mop which can be readily and easily laundered without appreciably damaging the twisted yarns therein.

Another object of the present invention is to provide a dust mop which has cut pile tufts which stay in singular condition.

Another object of the present invention is to provide a mat, such as a scatter rug or throw rug, which has an improved useful life.

Another object is to create a carpet shampoo bonnett that can be used on stain resistant treated carpet that will not create friction sufficient enough to remove the finish.

Another object of the present invention is to provide a mat which has yarns that will readily break or untwist.

Another object of the present invention is to provide a mop which has twisted yarns which do not readily mat together and which will remain in a singular condition with respect to each other.

Other objects, features, and advantages of the present invention will become apparent from the following description when taken in conjunction with the accompanying drawings wherein like characters of reference designate corresponding parts throughout the several views and wherein.

DETAILED DESCRIPTION OF THE DRAWINGS

Figure 1:
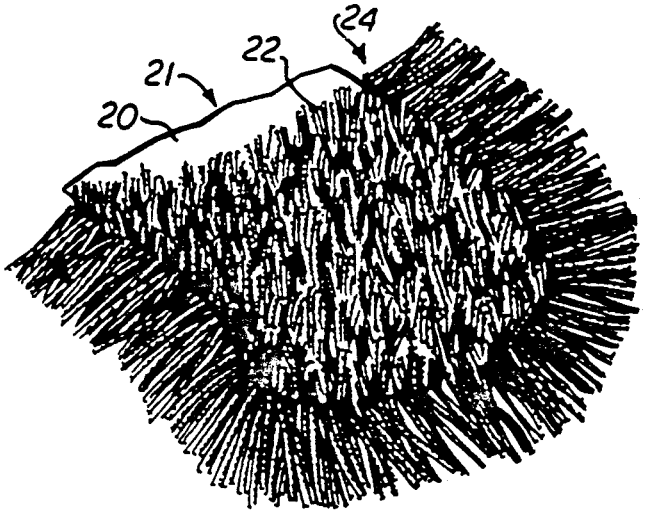
FIG. 1 is a top plan view of a portion of a dust mop or throw rug or scatter rug constructed in accordance with the present invention.

Referring now in detail to the embodiments chosen for the purpose of illustrating the present invention, the yarn of the present invention is constructed using conventional equipment and, therefore, it is not deemed necessary to illustrate the equipment which is being employed. Suffice it to state that the partially completed twisted yarn 10 of FIG. 2 includes a pair of opposed complimentary plies 11 and 12 which are helically twisted about a central core or strand 14 as the core is also twisted. The core 14 is a thermoplastic monofilament binder in the form of a yarn or filament. The two plies 11 and 12 are respectively spun from cellulosic fibers, such as short staple cotton or spun cotton rayon. The cotton or rayon should have a staple length of from about ½ inch to about 1⅛ inches, while the rayon fibers should have a fiber length of about 9/16 inch to about 1¼ inches. The cotton plies 11 and 12 are twisted with the filament, to form a balanced yarn 10, the singles of which have between one and two twists per inch and preferably one and one-half twists per inch whereas each ply 11 or 12 has from about two to about four twists per inch and preferably about three and one quarter twists per inch to produce a balanced yarn.

The core or strand 14, which forms the central part of the partially finished twisted yarn 10, is a monofilament thermoplastic line, yarn or filament formed of low melt polyethylene or low melt polypropylene. This central core 14 should have a melting point or melting range between about 170° F. and about 280° F. Preferably the central core, strand or filament 14 should melt between about 185° F. and 205° F.

Producing a twisted yarn having a straight central core or strand 14, twisted about its axis and helically wound plies is quite easily accomplished by restraining the thermoplastic filament 14 or strand fed to the twister while applying less restraint to the plies 11 and 12. This progressively forms a double helix of plies 11 and 12 twisted about the twisted core or strand 14 which remains in the center of the composite yarn 10.

Figure 2:
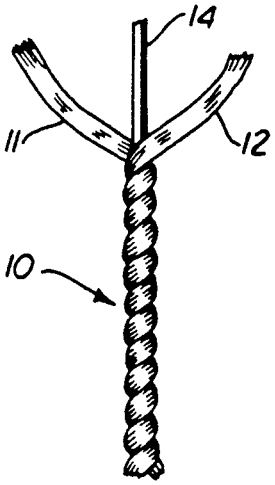
FIG. 2 is a side elevational view of a partially completed twisted yarn constructed in accordance with the present invention.

After emerging from the twister in the condition depicted in FIG. 2, the partially finished yarn 10 is either wrapped onto a spool in a conventional manner and passed to a package dying apparatus, or subjected to a skein apparatus where the spool carrying the yarn is heated to a temperature of about 185° F. to about 205° F. A portion of the resulting finished yarn 10 is shown in FIG. 3.

The cotton count of the yarn plies 11 and 12 is from about 1.0 to about 4.0 and the plies of yarns can be from two to eight plies in the resulting product.

The heating of the partially finished yarn 10, causes the central axially twisted core 14 to become tacky or to melt, so that, when cooled, the thermoplastic bonds substantially permanently the inner portions of the two plies 11 and 12, together, while their outer portions consist only of the original fibers. Of course, it will be realized that other methods of heating the partially finished yarn 10 of FIG. 2 so as to melt the core 14 and cause it, upon cooling, to bind the plies 11 and 12 together to produce the finished yarn 10 of FIG. 3, can be used to achieve a bonding of the two plies 11 and 12. The resulting finished yarn 10 does not readily unravel or shed lint while the outer fibers remain pliable and hydrophilic.

Figure 3:
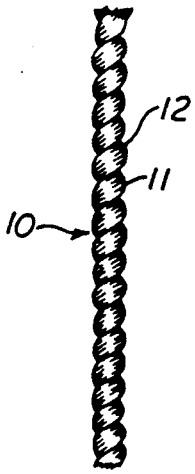
FIG. 3 is a side elevational view of the twisted yarn of FIG. 1 after it has been heat treated.

When producing a product, such as a dust mop or mat, the finished yarns, such as finished yarn 10, depicted in FIG. 3 are threaded into an appropriate cut pile tufting machine and are then tufted into the base 20 of the backing or body 21. The tufts 22, thus provide pairs of cut pile tufts which have individual yarns or tufts 22 of equal length and which protrude beyond the backing 21 by about 1½ inches.

If the resulting twisted product is to be a dust mop a fringe 24 is stitched around the perimeter of the backing 20 the fringe 24 being formed from lengths of finished yarn 10 of FIG. 3, about 6½ inches in length. The stitching holds the midportion of each length to provide pairs of outwardly protruding individual segments, about 3 inches long. A mat, such as a scatter rug or throw rug is formed in the same manner as a mop.

In the event that the product in FIG. 3 is to be a shampoo pad or shampoo bonnett for shampoo a stain resistant treated carpet, the finished yarns 10*a* should have plies plies which are essentially 100% cotton. Such a pad or shampoo bonnett when so used will not cause friction sufficient to remove an appreciable amount of the finish from the carpet.

It will be obvious to those skilled in the art that many variations may be made in the embodiment chosen for the purpose of illustrating the present invention, without departing from the scope thereof as defined by the appended claims.

I claim:

1. A twisted yarn which is suitable for use in a mop and which is absorbent, flexible and does not readily untwist comprising:

(a) a pair of individually twisted plies formed of cellulosic fibers, said plies being twisted together to form a balanced double helix yarn, the outer portions of said twisted plies remaining hydrophilic;

(b) a thermoplastic binder in the interior of said yarn and around which said plies pass, said binder binding only the inner portions of said plies together;

(c) said cellulosic fibers being selected from the group consisting of cotton fibers and cotton rayon fibers;

(d) the twist of each ply being from about 2 twists per inch to about 4 twists per inch;

(e) said twisted yarn having from about 1 to about 2 twists per inch; and (f) said thermoplastic binder being selected from the group consisting of polyethylene and polypropylene having a melting point from about 170° F. to about 205° F.

* * * * *